US009989283B2

(12) United States Patent
Alahyari et al.

(10) Patent No.: US 9,989,283 B2
(45) Date of Patent: Jun. 5, 2018

(54) HEAT EXCHANGER AND FLOW DISTRIBUTOR

(71) Applicant: CARRIER CORPORATION, Farmington, CT (US)

(72) Inventors: Abbas A. Alahyari, Manchester, CT (US); Thomas D. Radcliff, Vernon, CT (US); Richard Rusich, Ellington, CT (US)

(73) Assignee: CARRIER CORPORATION, Farmington, CT (US)

( * ) Notice: Subject to any disclaimer, the term of this patent is extended or adjusted under 35 U.S.C. 154(b) by 3 days.

(21) Appl. No.: 14/911,324

(22) PCT Filed: Jun. 5, 2014

(86) PCT No.: PCT/US2014/040995

§ 371 (c)(1),
(2) Date: Feb. 10, 2016

(87) PCT Pub. No.: WO2015/023347

PCT Pub. Date: Feb. 19, 2015

(65) Prior Publication Data

US 2016/0298887 A1 Oct. 13, 2016

Related U.S. Application Data

(60) Provisional application No. 61/864,756, filed on Aug. 12, 2013.

(51) Int. Cl.

| | |
|---|---|
| ***F28F 9/02*** | (2006.01) |
| ***F25B 39/00*** | (2006.01) |
| ***F25B 39/02*** | (2006.01) |

(52) U.S. Cl.

CPC ..... *F25B 39/00* (2013.01); *F25B 39/028* (2013.01); *F28F 9/0273* (2013.01); *F28F 9/027* (2013.01); *F28F 9/0275* (2013.01)

(58) Field of Classification Search

CPC ..... F25B 39/028; F25B 39/00; F28F 9/0273; F28F 9/02; F28F 9/0275; F28F 9/0202; F28F 9/028; F28F 9/027; F28F 9/0263

(Continued)

(56) References Cited

U.S. PATENT DOCUMENTS 2,044,455 A * 6/1936 Witzel ..... F25B 39/02 165/174
4,513,587 A * 4/1985 Humpolik ..... F25B 39/02 138/42

(Continued)

FOREIGN PATENT DOCUMENTS

CN 101943539 A * 1/2011
EP 2375209 A2 10/2011

(Continued)

OTHER PUBLICATIONS

International Search Report for application PCT/US2014/040995 dated Sep. 16, 2014, 10 pages.

*Primary Examiner* — Len Tran
*Assistant Examiner* — Paul Alvare
(74) *Attorney, Agent, or Firm* — Cantor Colburn LLP

(57) ABSTRACT

A heat exchanger includes a distribution manifold, a plurality of longitudinally spaced tubes having inlet ends opening into the manifold, and a longitudinally extending distributor body disposed within the manifold. The distributor body has a first surface juxtaposed in spaced relationship with the inlet ends of the plurality of tubes and a second surface interfacing with the manifold inner wall. A plurality of discrete flow passages extend from an inlet end of the distributor body and open through the first surface of the distributor body. The plurality of discrete flow passages includes a plurality of longitudinally extending flow passages formed by channels or grooves extending along the (Continued)

interface of the second surface of the distributor body with the inner wall of the distributor manifold.

17 Claims, 5 Drawing Sheets

(58) Field of Classification Search
USPC ..... 165/174
See application file for complete search history.

(56) References Cited

U.S. PATENT DOCUMENTS 5,806,586 A 9/1998 Osthues et al.
5,901,785 A * 5/1999 Chiba ..... F28D 1/0341 165/153
5,910,167 A 6/1999 Reinke et al.
7,086,249 B2 8/2006 Bae et al.
7,331,195 B2 2/2008 Bae et al.
7,503,382 B2 3/2009 Maezawa et al.
7,967,060 B2 6/2011 Trumbower et al.
8,113,270 B2 2/2012 Rios et al.
8,171,987 B2 5/2012 Jiang et al.
8,225,853 B2 7/2012 Maori et al.
2007/0039724 A1* 2/2007 Trumbower ..... F25B 39/028 165/174
2008/0023185 A1* 1/2008 Beamer ..... F28D 1/05375 165/174
2008/0190134 A1 8/2008 Khatib et al.
2009/0173482 A1 7/2009 Beamer et al.
2010/0089559 A1* 4/2010 Gorbounov ..... F25B 39/028 165/174
2010/0242535 A1* 9/2010 Jianlong ..... F28F 9/0273 62/524
2010/0314090 A1 12/2010 Moriya et al.
2011/0017438 A1 1/2011 Huazhao et al.

FOREIGN PATENT DOCUMENTS

EP 2520887 A2 11/2012
JP 2002303499 A * 10/2002 ..... F28F 9/0273
JP 2003161547 A 6/2003
JP 2011085324 A 4/2011
JP 2013234839 A * 11/2013 ..... F28F 9/02
WO 2008048251 A2 4/2008
WO 2008048505 A2 4/2008
WO WO 2009002256 A1 * 12/2008 ..... F25B 41/062
WO 2013076993 A1 5/2013

* cited by examiner

HEAT EXCHANGER AND FLOW DISTRIBUTOR

BACKGROUND OF THE INVENTION

This disclosure relates generally to heat exchangers and, more particularly, to providing a more uniform distribution of fluid amongst a plurality of parallel, fluid conveying passages of a parallel flow heat exchanger.

Parallel flow heat exchangers include a plurality of spaced parallel passages for conveying a first fluid in heat exchange relationship with a second fluid. A type of parallel flow heat exchanger commonly used as refrigerant evaporators, condensers, and gas coolers in refrigeration and air conditioning applications, as well as used as fluid heating and cooling heat exchangers in other applications, includes a plurality of tubes defining the fluid conveying passages. The tubes are disposed in spaced parallel relationship and open into a common manifold for receiving fluid. Typically, it is desirable that each tube, and even channel for multi-channel tubes receive an equal flow of fluid a fluid chamber within to the manifold into which the inlet end of the tubes open. However, conventional parallel flow heat exchangers, in particular parallel flow heat exchangers having multi-channel tubes, such as mini-channel or micro-channel tubes, suffer from fluid maldistribution, that is from a lack of uniformity in the amount of fluid distributed to each individual multi-channel tube.

Flow maldistribution is particularly problematic in applications where a two-phase fluid is delivered to the fluid chamber of the manifold for distribution amongst an aligned array of the plurality of tubes opening into the fluid chamber of the manifold at spaced intervals along the length of the manifold. For example, in a conventional refrigeration/air conditioning cycle, refrigerant is expanded in an expansion valve and then delivered into the manifold of the evaporator as a two-phase mixture of refrigerant vapor and refrigerant liquid. It is generally accepted that flow maldistribution in two-phase flow heat exchangers may primarily be attributed to the difference in densities of liquid phase and the vapor phase. Additionally, gravity forces may separate the liquid and vapor phases as the two-phase mixture passes along the length of the manifold.

It has been recognized that the maldistribution of the refrigerant flow amongst the tubes of a parallel flow heat exchanger may adversely impact evaporator performance and degrade overall system performance. U.S. Pat. Nos. 8,113,270 and 8,171,987, for example, each disclose the use of an elongated distributor tube inserted within and extending along the longitudinal axis of an inlet manifold of a heat exchanger for distributing a two-phase flow along the length of the manifold.

Although the concept of an elongated distribution tube within the inlet header of heat exchanger has been successful in reducing two-phase flow maldistribution, the need still exists for a two-phase flow distributor and heat exchanger that address the maldistribution of the liquid-phase and the vapor-phase in the fluid flow distribution amongst a plurality of flow passages opening to an inlet manifold of a parallel flow heat exchanger.

SUMMARY OF THE INVENTION

A parallel flow heat exchanger includes a distribution manifold having a manifold inner wall enclosing a manifold volume, a plurality of longitudinally spaced tubes having inlet ends opening into the manifold volume, and a longitudinally extending distributor body disposed within the manifold volume. The distributor body has a first surface juxtaposed in spaced relationship with the inlet ends of the plurality of tubes and a second surface interfacing with the manifold inner wall. A plurality of discrete flow passages extend from a first end of the distributor body and opening through the first surface of the distributor body. The plurality of discrete flow passages includes a plurality of longitudinally extending passages formed along the interface of the second surface of the distributor body with the inner wall of the distributor manifold. The plurality of discrete flow passages may further include a plurality of transversely extending flow passages, each longitudinally extending flow passage being in fluid flow communication with a respective subplurality of said plurality of transversely extending flow passages. Each respective subplurality of the transversely extending flow passages comprises a continuous sequential subplurality of the transversely extending flow passages distinct from all other subpluralities of the transversely extending flow passages.

A fluid flow distributor includes a longitudinally elongated distributor manifold, a longitudinally elongated distributor body disposed within the distributor manifold, and a plurality of discrete flow passages. The distributor manifold has a bounding wall defining an interior manifold volume and has an array of a plurality of longitudinally spaced slots extending through the bounding wall. The distributor body has a first surface juxtaposed in spaced relationship with and facing the array of slots and a second surface interfacing with the bounding wall of the distributor manifold. The plurality of discrete flow passages extend from a first end of the distributor body to open through the first surface. The plurality of discrete flow passages include a plurality of longitudinally extending flow passages and a plurality of transversely extending flow passages opening through the first surface at longitudinally spaced intervals. Each longitudinally extending flow passage of the plurality of longitudinally extending flow passages is in fluid flow communication with at least one transversely extending flow passage of the plurality of transversely extending flow passages.

In an embodiment, a plurality of channels are formed in the second surface of the distributor body, the plurality of channels forming, in cooperation with the bounding wall of the distribution manifold, the plurality of discrete longitudinally extending flow passages. In an embodiment, a plurality of channels are formed in an inner surface of the bounding wall of the distribution manifold, said plurality of channels forming, in cooperation with the second surface of the distributor body, the plurality of discrete longitudinally extending flow passages. In an embodiment, the manifold may have a circular cross section and the distributor body may have a generally D-shaped semi-circular cross-section. In an embodiment, the distributor manifold may have a non-circular cross-section and the second surface of the distributor body may conform to an interfacing section of an inner surface of the bounding manifold wall.

In an embodiment, a plurality of discharge ports are formed in the first surface of the distributor body opening to the manifold volume, each respective discharge port of the plurality of discharge ports in fluid flow communication with a respective one of the plurality of discrete fluid flow passages. Each fluid flow passage of the plurality of discrete fluid flow passages communicates in fluid flow communication with a selected grouping of a subplurality of the plurality of longitudinally spaced discharge ports. The plurality of discharge ports may be arranged in a single longitudinally extending column or in a plurality of longitudinally extending columns, or the plurality of discharge ports may be arranged in an array of a plurality of longitudinally spaced rows and a plurality of laterally spaced columns.

In an embodiment, a longitudinally extending discharge slot is formed in the first surface of the distributor body opening to the manifold, the plurality of discrete fluid flow passages in fluid flow communication with the discharge slot. In an embodiment, the distributor body includes a longitudinally extending trench in fluid flow communication with each of the plurality of fluid flow passages and in fluid flow communication with a longitudinally elongated discharge slot.

A method is provided for distributing a two-phase fluid flow amongst a plurality of heat exchange tubes of a heat exchanger having a fluid distribution manifold having an inner wall bounding an interior volume, the heat exchange tubes having inlet ends opening into the interior volume of said fluid distribution manifold. The method includes: providing a distributor body having a first surface and a second surface, the second surface configured to conform to a section of the inner wall of the fluid distribution manifold; disposing the distributor body within the interior volume of the distribution manifold with the first surface facing the inlet ends of the heat exchanges tubes and the second surface interfacing with the inner wall of the distribution manifold; and providing a plurality of fluid flow passages extending from an inlet end of the distributor body to open through the first surface of the distributor body, each fluid flow passage including a longitudinally extending passage extending along the interface between the second surface of the distributor body and the inner wall of the distribution manifold and a plurality of transversely extending passages opening through the first surface of the distributor body, each fluid flow passage of said plurality of fluid flow passages delivering fluid flow to a respective region of the heat exchanger.

DETAILED DESCRIPTION OF THE DRAWINGS

For a further understanding of the disclosure, reference will be made to the following detailed description which is to be read in connection with the accompanying drawings, wherein.

DETAILED DESCRIPTION

Figure 1:
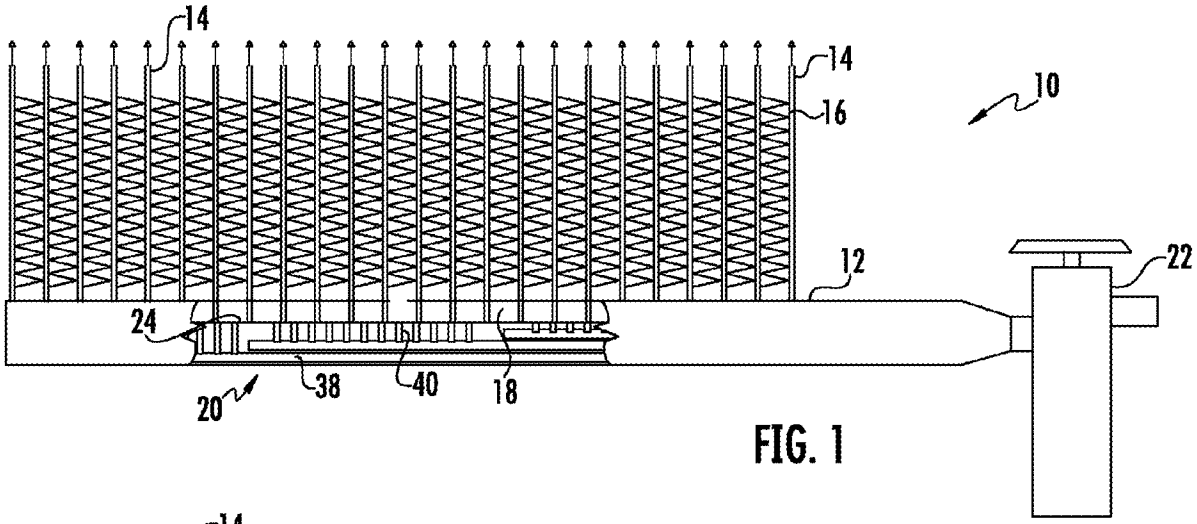
FIG. 1 is a side elevation view, partly sectioned, of an embodiment of a parallel flow heat exchanger embodying the invention.

Referring now to FIG. 1, there is depicted, partly in section, a parallel flow heat exchanger 10 including a fluid distribution manifold 12 and a plurality of parallel disposed and longitudinally spaced tubes 14 extending between the fluid distribution manifold 12 and a fluid collection manifold (not shown). The tubes 14 define parallel heat exchanger flow passes 16 opening into the respective interior chambers of the fluid distribution manifold 12 and the fluid collection manifold (not shown) for conveying fluid from the fluid distribution manifold 12 to the fluid collection manifold. A fluid flow distributor 20 is provided for distributing fluid received in the interior chamber 18 of the fluid distribution manifold 12 amongst the parallel flow passes 16. The tubes 14 of the heat exchanger 10 are depicted as flattened multichannel tubes wherein each of the parallel flow passes 16 is subdivided into a plurality of "microchannel" or "minichannels" flow passages. Microchannel and minichannel tubes differ only by channel size, i.e. the hydraulic diameter of the channel. The term multichannel heat exchanger refers to both minichannel and microchannel heat exchangers.

The invention disclosed herein will be further described with the reference to the heat exchanger 10 in application as an evaporator heat exchanger in a direct expansion refrigeration system (not shown) wherein refrigerant flowing through the refrigeration system passes in heat exchange relationship with a heating fluid, for example air to be cooled, and is evaporated as the refrigerant traverses the heat exchanger 10. Prior to entering the interior chamber 18 of the fluid distribution manifold 12, the refrigerant traverses an expansion device 22, for example a thermostatic expansion valve, an electronic expansion valve, a capillary tube, or other expansion device. As the refrigerant passes through the expansion device 22, the refrigerant is expanded from a higher pressure liquid to a lower pressure two-phase mixture of refrigerant liquid and refrigerant vapor.

Referring now to FIGS. 2-5, the fluid flow distributor 20 disclosed herein includes a distributor body 24 housed within the fluid distribution manifold 12. The distributor body 24 has a first surface 26 and a second surface 28. The distributor body 24 is inserted within the interior chamber 18 of the fluid distribution manifold 12 in the space between the inlet ends of the heat exchanger tubes 14 that open into fluid distribution manifold 12 and the opposite inner wall 30 of the fluid distribution manifold 12 with the first surface 26 of the distributor body 24 facing and spaced at a gap from the plurality of flow passages 16 of the tubes 14 that open to the interior chamber 18 of the fluid distribution manifold 12 and with the second surface 28 of the distributor body 24 interfacing with an inner wall 30 of the fluid distribution manifold 12.

The first surface 26 of the distributor body 24 has a plurality of discharge ports 32 therein opening to the interior chamber 18 of the fluid distribution manifold 12. A plurality of flow passages 36 extend from an inlet end 34 of the distributor body 24 to the discharge ports 32 in the first surface 26 of the distributor body 24. Each flow passage 36 includes a longitudinally extending passage 38 and a plurality of transversely extending flow passages 40. The plurality of transversely extending passages 40 extend through the otherwise solid extrusion forming the distributor body 24 to open through a corresponding number of the plurality of discharge ports 32 to the region of the interior volume 18 bounding the first surface 26 of the distributor body 24. The discharge ports 32 and the transversely extending flow passages 40 may be drilled into the solid distributor body 24 and may, for example, have a diameter on the order of 1 to 2 millimeters, although other diameters may be used. The number of discharge ports 32 need not be equal in number to the number of fluid passes 16 of heat exchanger 10. In an embodiment, a single discharge slot extending longitudinally the length of the first surface 26 of the distributor body 24 may replace and constitute the equivalent of the plurality of discrete ports 32. In an embodiment, a plurality of longitudinally extending discharge slots spaced along the length of the first surface 26 of the distributor body 24 may replace and constitute an equivalent of the plurality of discrete ports 32.

Figure 3:
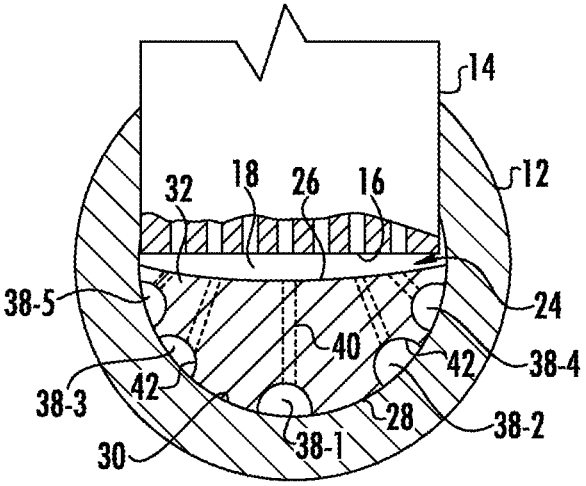
FIG. 3 is a sectioned plan view taken along line 3-3 of FIG. 2.
Figure 4:
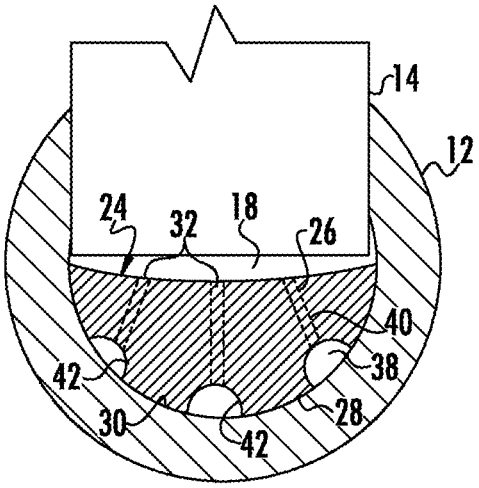
FIG. 4 is a sectioned elevation view taken alone line 4-4 of FIG. 2.
Figure 6:
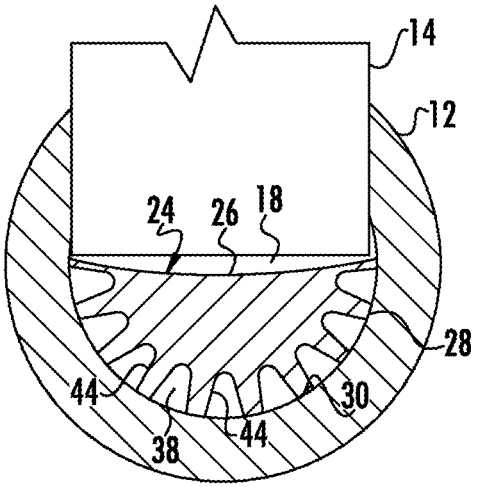
FIG. 6 is a sectioned end elevation view of another embodiment of the distributor body disclosed herein.

The plurality of longitudinally extending passages 38 may extend longitudinally from the inlet end 34 of the distributor body 24 along the interface between the second surface 28 of the distributor body 24 and the inner wall 30 of the fluid distribution manifold 12. In an embodiment, the longitudinally extending passages 38 may comprise channels formed in the second surface 28. In an embodiment, the channels formed in the second surface 28 may comprise longitudinally extending grooves 42 having a generally semi-circular cross-section, such as depicted in FIGS. 3-4, or having a generally semi-elliptical, a rectangular or other cross-section. In an embodiment, the channels formed in the second surface 28 may comprise longitudinally extending troughs 44 having a generally V-shaped cross-section, such as depicted in FIG. 6, that are comparatively deeper than the relatively shallower grooves 42. In the embodiments depicted in FIGS. 3, 4 and 6, the open sides of the longitudinally extending channels, that is the open sides of grooves 42 or troughs 44, interface with and are closed by the section of the inner wall 30 of the fluid distribution manifold 12. Thus, the plurality of channels 42, 44 formed in the second surface 28 of the distributor body 24 in cooperation with the bounding inner wall 30 of the fluid distributor manifold 12 form the plurality of discrete longitudinally extending flow passages 38.

Figure 7:
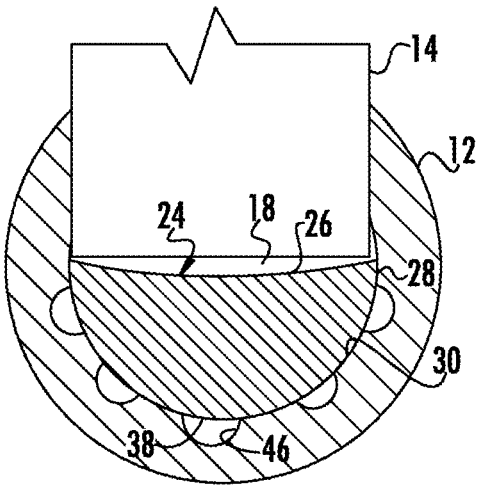
FIG. 7 is a sectioned end elevation view of another embodiment of the distributor body disclosed herein.

In another embodiment, the longitudinally extending passages 38 may comprise channels, such as semi-circular grooves 46 as depicted in FIG. 7, formed in the surface of the inner wall 30 of the fluid distribution manifold 12. In this embodiment, the open sides of the longitudinally extending grooves 46 interface with and are closed by the second surface 28 of the distributor body 24. Thus, the plurality of channels 46 formed in the bounding surface of the inner wall 30 of the fluid distribution manifold 12 in cooperation with the second surface 28 of the distributor body 24 form the plurality of discrete longitudinally extending flow passages 38.

Accordingly, in each of the embodiments depicted in FIGS. 3, 4, 6 and 7, a plurality of discrete longitudinally extending flow passages 38 are formed by the channels or grooves 42, 44, 46 extending along the interface of and cooperatively by the second surface 28 of the distributor body 24 and the bounding portion of the inner wall 30 of the fluid distributor manifold 12. The respective hydraulic diameters and respective overall lengths of the individual fluid flow passages 36 may be individually adjusted to equalize the pressure drop through the various fluid flow passages in order to equalize fluid flow through the fluid flow passages 36 to different regions of the heat exchanger 10. The channels or grooves 42, 44, 46 may extend from the inlet end of the distributor body 24 for the full length of the distributor body 24 or may extend from the inlet end of the distributor body 24 for only part of the length of the distributor body 24. That is, a particular channel or groove 42, 44, 46 may extend from the inlet end of the distributor body 24 only for a distance necessary to deliver fluid flow to a specific region of the heat exchanger.

As noted hereinbefore, a plurality of transversely extending flow passages 40 extend through the distributor body 24. Each transversely extending flow passage 40 opens at a first end to the interior volume 18 through a respective one of the discharge ports 32 formed in the first surface 26 of the distributor body 24 at longitudinally spaced intervals. Each transversely extending flow passage 40 opens at its other end into one of the longitudinally extending passages 38, thereby providing a fluid flow path extending from the interior volume 18 of the fluid distribution manifold 12 upstream of the inlet end 34 of the distributor body 24, through the distributor body 24 to open through a respective one of the discharge ports 32 into the portion of the interior volume 18 lying between the first surface 26 of the distributor body 24 and the inlet ends of the heat exchanger tubes 14.

Figure 5:
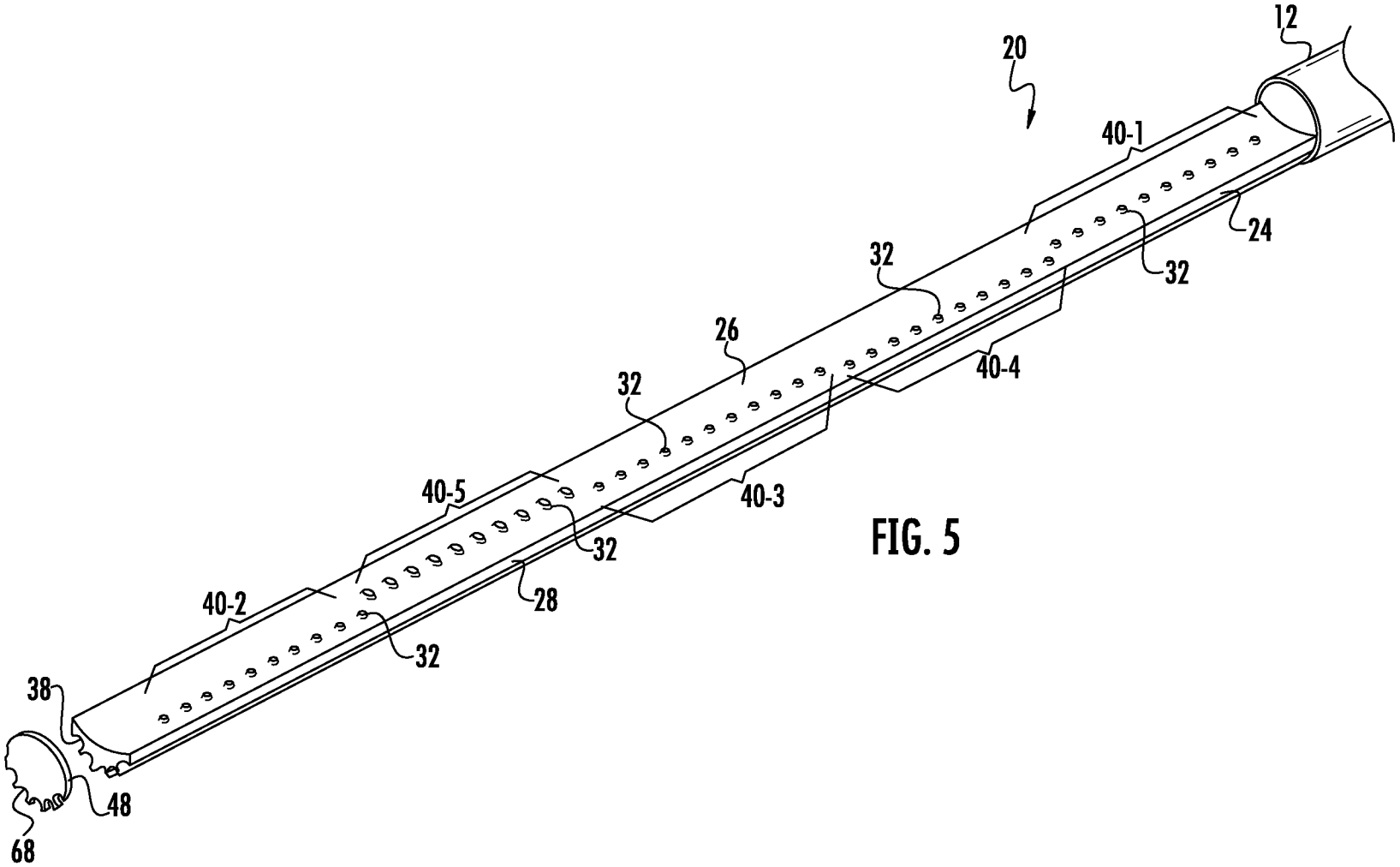
FIG. 5 is an exploded perspective view illustrating insertion of the fluid low distributor insert into the manifold of the heat exchanger.

Referring now to FIG. 5 in particular, the distributor 20 is assembled by inserting the distributor body 24 fully into the interior volume 18 bounded by the inner wall 30 of the fluid distribution manifold 12. The distributor body may be formed as an extruded solid body having the channels forming the longitudinally extending passages 38 formed in its second surface 28 during the extrusion process. The transversely extending passages 40 may be drilled into the extruded distributor body 24. The distributor body 24 may be held within the fluid distribution manifold 12 by force fit or the distributor body 24 may be bonded to the inner wall 34 of the fluid distribution manifold 12. In an embodiment, a brazing compound may be applied to the second surface 28 of the distributor body 24 and/or to the inner wall 34 of the fluid distribution manifold 12, whereby the distributor body 24 and the inner wall 34 interfacing with the second surface 28 may be bonded together by brazing, for example when the assembled heat exchanger 10 is heated in a brazing furnace.

An end plate 48 disposed at the upstream end of the distributor body 24 extends across interior volume 18 of the distributor body 24 so that fluid must flow into the channels 42, 44, 46, and cannot flow directly along the first surface 26 of the distributor body 24. The end plate 48 includes a plurality of ports 60 commensurate in number to the number of longitudinally extending flow passages 38 and positioned in alignment with the openings to the channels forming the longitudinally extending flow passages 38. The ports 60 may comprise flow control orifices for allowing a degree of selective adjustment of the flow area opening to the individual flow passages 38 to precisely apportion the flow of the homogenous two-phase mixture amongst the fluid flow passages 38 to account for differences in frictional losses due to the different lengths of the fluid flow passages 38. End plate 48 may be formed integrally with the upstream/inlet end of the distributor body 24 or may be a separate piece that is simply positioned in abutting relationship to the upstream/inlet end of the distributor body 24.

Each longitudinally extending flow passage 38 is in fluid flow communication with a respective subset of the plurality of transversely extending flow passages 40. Each respective subset of the plurality of transversely extending flow passages 40 comprises a continuous sequential grouping of a selected subplurality of the plurality of transversely extending flow passages 40 distinct from all other subsets of the transversely extending flow passages 40. Therefore, each longitudinally extending flow passage 38 is in fluid flow communication with a unique subset of the plurality of transversely extending flow passages 40 relative to all other longitudinally extending flow passages 38.

For example, in the embodiment of the distributor body 24 depicted in FIGS. 1-5, the distributor 20 has five longitudinally extending flow passages 38 formed in the second surface 26 of the distributor body 24 in cooperation with the bounding inner wall 34 of the distributor manifold 12. A first longitudinally extending flow passage 38-1 of the plurality of longitudinally extending flow passages 38 is in fluid flow communication with a first subset 40-1 of the plurality of transversely extending flow passages 40. A second longitudinally extending flow passage 38-2 of the plurality of longitudinally extending passages 38 is in fluid flow communication with a second subset 40-2 of the plurality of transversely extending flow passages 40. A third longitudinally extending flow passage 38-3 of the plurality of longitudinally extending flow passages 38 is in fluid flow communication with a third subset 40-3 of the plurality of transversely extending flow passages 40. A fourth longitudinally extending flow passage 38-4 of the plurality of longitudinally extending passages 38 is in fluid flow communication with a fourth subset 40-4 of the plurality of transversely extending flow passages 40. A fifth longitudinally extending flow passage 38-5 of the plurality of longitudinally extending passages 38 is in fluid flow communication with a fifth subset 40-5 of the plurality of transversely extending flow passages 40.

Figure 8:
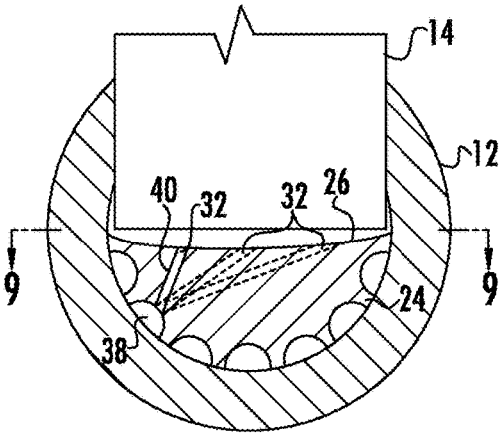
FIG. 8 is a cross-sectional elevation view of a further embodiment of the distributor body disclosed herein.
Figure 9:
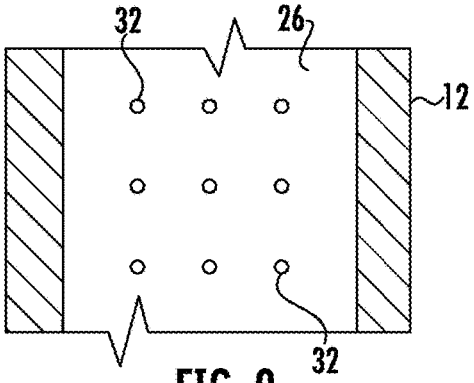
FIG. 9 is a sectioned plan view taken along line 9-9 of FIG. 8.

Referring now to FIGS. 8 and 9, in another embodiment of the fluid distributor 20 disclosed herein, the plurality of discharge ports 32 in the first surface 26 of the distributor body 24 are arranged in a matrix pattern including a plurality of laterally spaced columns and longitudinally spaced rows. Thus, at each longitudinally spaced axial discharge location through the first surface 26 along the longitudinal extent, i.e. length, of the distributor body 24, a plurality of discharge ports 32 are provided across the lateral extent, i.e. width, of the first surface 26 of the distributor body 24. Again, each transversely extending fluid flow passage 40 extends from one of the longitudinally extending passages 38 to open through a respective one of the plurality of discharge ports 32. In this embodiment, the homogenous fluid flow passing through a longitudinally extending fluid flow passage 40 is delivered at each longitudinally spaced axial discharge location through a plurality of laterally spaced discharge ports 32, thereby facilitating a more uniform lateral distribution of fluid across the plurality of flow passages 16 of a tube 14.

Figure 10:
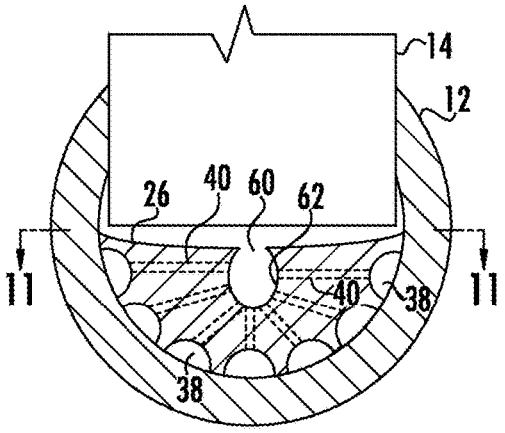
FIG. 10 is a cross-sectional elevation view of a still further embodiment of the distributor body disclosed herein.
Figure 11:
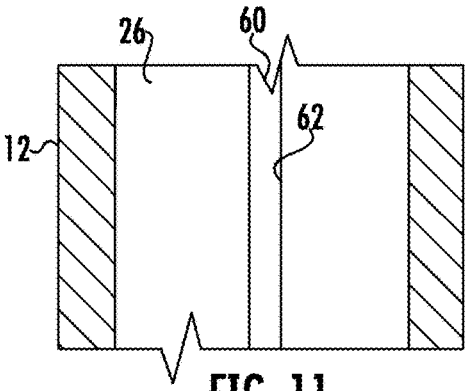
FIG. 11 is a sectioned plan view taken along line 11-11 of FIG. 10.

As noted previously, in an embodiment of the distributor 20 disclosed herein, a longitudinally extending discharge slot may be provided in the first surface 26 of the distributor body 24, rather than a plurality of discharge ports 32, for delivering the fluid flow to the interior volume bounding the first surface 26 of the distributor body 24. In the embodiment of the distributor 20 depicted in FIGS. 10 and 11, a longitudinally extending discharge slot 60 communicates with a longitudinally extending trench 62 formed in the distributor body 24 and forms a discharge opening through which fluid passes from the trench 62 into the interior volume bounding the first surface 26. The plurality of transversely extending fluid flow passages 40 extend from the plurality of longitudinally extending fluid flow passages 38 to open in fluid communication to the trench 62.

Generally, if the number of longitudinally extending passages 38 is "n", each longitudinally extending passage 38 will be in fluid flow communication with "1/n" of the transversely extending passages 40. However, it is not necessary that all longitudinally extending flow passages 38 be in fluid flow communication with the same number of transversely extending flow passages 40. If desired, one or more of the longitudinally extending flow passages 38 may be in fluid flow communication with a greater number or a lesser number of transversely extending flow passages 40 as compared to the other longitudinally extending flow passages 38. The number of longitudinally extending passages 38 provided depends on the fluid flow requirements for a particular application, the size of the distributor body, and structural considerations. Typically, the number of longitudinally extending passages 38 will range from 3 to 9.

The distributor 20 may further include a nozzle plate 50 disposed upstream of and in spaced relationship with the distributor body 24 forming a mixing chamber 52 within the interior volume 18 of the fluid distribution manifold 12 between the end plate 48 at the inlet end 34 of the distributor body 24 and the nozzle plate 50. In an embodiment, the nozzle plate 50 may be disposed at an inlet end of the fluid distribution manifold 12. In an embodiment, the nozzle plate 50 may comprise a fixed flow area orifice plate. In an embodiment, the nozzle plate 50 may comprise a convergent-divergent nozzle or a venturi nozzle. As the liquid and vapor phase mixture passing into the distribution manifold 12 traverses the nozzle plate 50, the velocity of the mixture increases which ensures that a uniform homogenous two-phase mixture exists within the mixing chamber 52 prior to entering the discrete fluid flow passages.

Figure 2:
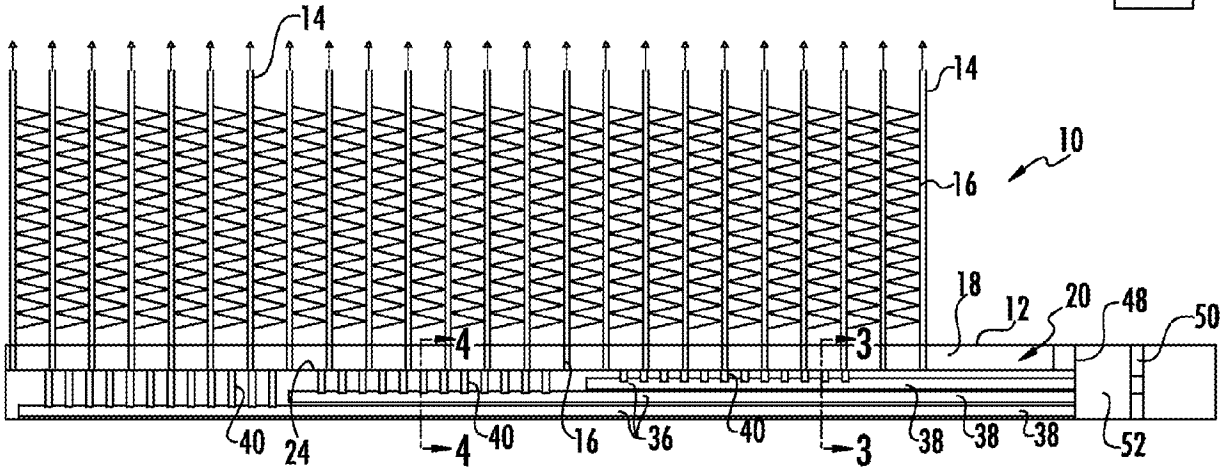
FIG. 2 is a sectioned side elevation view of the heat exchanger of FIG. 1 showing an inlet manifold, a plurality of heat exchange tubes, a fluid flow distributor in accordance in the disclosure.

In the depicted embodiments, the fluid distribution manifold 12 has a circular cross section and the distributor body 24 has a generally D-shaped semi-cylindrical cross section. However, it is to be understood that the fluid distribution manifold 12 and the distributor body 24 may have a non-circular cross-section so long as the second surface 28 of the distributor body 24 conforms to the inner wall of the fluid distribution manifold 12. Although the distributor body 24 is depicted in FIGS. 1 and 2 as extending linearly within a linearly extending fluid distribution manifold 12, it is to be understood that the distributor body 24 may be arcuate or bent at an angle so as extend non-linearly for insertion into a fluid distribution manifold that similarly extends non-linearly.

In the depicted embodiments, the longitudinally extending flow passages 38 extend along the interface of the distributor body 24 with the fluid distribution manifold 12. However, in another embodiment, the longitudinally extending flow passages 38 may be formed internally within the distributor body 24, for example during extrusion of the distributor body 24 or by a drilling operation subsequent to formation of the distributor body, rather than along the interface of the distributor body 24 with the fluid distribution manifold 12. In a further embodiment of the fluid flow distributor 20, the distributor body 24 and the fluid distribution manifold 12 may be formed as an integral body, for example as a single piece extrusion.

The fluid flow distributor 20 disclosed herein is particularly useful in distributing a two-phase fluid amongst the heat exchange tubes of a heat exchanger so as to minimize maldistribution of the liquid and vapor phases resulting in improved heat exchanger performance, In air conditioning/refrigeration units employing evaporator heat exchangers incorporating the fluid flow distributor as disclosed herein will likely result in improved unit performance, including improving the coefficient of performance, reducing power consumption, and allowing for smaller and lighter evaporators.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

The invention claimed is:

1. A fluid flow distributor comprising:

a longitudinally elongated distributor manifold having a bounding wall defining an interior manifold volume and having an array of a plurality of longitudinally spaced slots extending through the bounding wall;

a longitudinally elongated distributor body disposed within said manifold volume, said distributor body having a first surface juxtaposed in spaced relationship with and facing said array of slots and a second surface interfacing with the bounding wall of said longitudinally elongated distributor manifold; and a plurality of discrete flow passages extending from a first end of said distributor body and opening through said first surface;

wherein said plurality of discrete flow passages comprise a plurality of longitudinally extending flow passages and a plurality of transversely extending flow passages separate from the plurality of longitudinally extending flow passages, the plurality of transversely extending flow passages opening through said first surface at longitudinally spaced intervals, each longitudinally extending flow passage of said plurality of longitudinally extending flow passages in fluid flow communication with at least one transversely extending flow passage of said plurality of transversely extending flow passages, at least two of the plurality of transversely extending flow passages having different lengths.

2. The fluid flow distributor of claim 1 further comprising a plurality of channels formed in said second surface of said distributor body, said plurality of channels forming in cooperation with the bounding wall of said distributor manifold said plurality of discrete longitudinally extending flow passages.

3. The fluid flow distributor of claim 1 further comprising a plurality of channels formed in an inner surface of the bounding wall of said distributor manifold, said channels forming in cooperation with said second surface of said distributor body said plurality of discrete longitudinally extending flow passages.

4. The fluid flow distributor of claim 1 further comprising a plurality of longitudinally spaced discharge ports in said first surface of said distributor body opening to said manifold volume, each respective discharge port of said plurality of discharge ports in fluid flow communication with a respective one of said plurality of fluid flow passages.

5. The fluid flow distributor of claim 4 wherein each fluid flow passage of said plurality of discrete fluid flow passages communicates in fluid flow communication with a selected grouping of a subplurality of said plurality of longitudinally spaced discharge ports.

6. The fluid flow distributor of claim 1 further comprising a plurality of discharge ports in said first surface of said distributor body opening to said manifold volume, said plurality of discharge ports arranged in an array of longitudinally spaced rows and laterally spaced columns, each respective discharge port of said plurality of discharge ports in fluid flow communication with a respective one of said plurality of fluid flow passages.

7. The fluid flow distributor of claim 1 further comprising a longitudinally extending discharge slot in said first surface of said distributor body opening to said manifold volume, said discharge slot in fluid flow communication with said plurality of fluid flow passages.

8. The fluid flow distributor of claim 7 further comprising a longitudinally extending trench formed within said distributor body, said trench opening to said discharge slot and said plurality of fluid flow passages opening in fluid flow communication to said trench.

9. The fluid flow distributor of claim 1 wherein said manifold has a circular cross section and said distributor body has a generally D-shaped semi-circular cross-section.

10. The fluid flow distributor of claim 1 wherein said manifold has a non-circular cross-section and said second surface of said distributor body conforms to an interfacing section of an inner surface of the bounding manifold wall.

11. A parallel flow heat exchanger comprising:

a distribution manifold having a manifold inner wall enclosing a manifold volume;

a plurality of longitudinally spaced tubes having inlet ends opening into said manifold volume;

a longitudinally extending distributor body disposed within said manifold volume, said distributor body having a first surface juxtaposed in spaced relationship with the inlet ends of said plurality of tubes and a second surface interfacing with said manifold inner wall; and a plurality of discrete flow passages extending from a first end of said distributor body and opening through said first surface of said distributor body;

wherein said plurality of discrete flow passages comprise a plurality of discrete flow passages comprising a plurality of longitudinally extending passages formed along the interface of the second surface of said distributor body with the inner wall of said distributor manifold and a plurality of transversely extending flow passages separate from the plurality of longitudinally extending flow passages, each longitudinally extending flow passage of said plurality of longitudinally extending flow passages in fluid flow communication with a respective subplurality of said plurality of transversely extending flow passages, at least two of the plurality of transversely extending flow passages having different lengths.

12. The parallel flow heat exchanger of claim 11 wherein each longitudinally extending flow passage of said plurality of longitudinally extending flow passages is in fluid flow communication with a subplurality of said plurality of transversely extending flow passages, and each respective subplurality of said plurality of transversely extending flow passages comprising a continuous arrangement of transversely extending flow passages of said plurality of transversely extending flow passages distinct from all other transversely extending flow passages of said plurality of transversely extending passages.

13. The parallel flow heat exchanger of claim 11 wherein said plurality of discrete flow passages comprises a plurality of longitudinally extending channels formed in the second surface of said distributor body, said plurality of channels forming in cooperation with said manifold inner wall said plurality of discrete longitudinally extending flow passages.

14. The parallel flow heat exchanger of claim 11 wherein said plurality of discrete flow passages comprises a plurality of longitudinally extending channels formed in said manifold inner wall, said plurality of channels forming in cooperation with the second surface of said distributor body said plurality of discrete longitudinally extending flow passages.

15. The parallel flow heat exchanger of claim 11 further comprising a nozzle plate disposed in an inlet end of said manifold and spaced upstream of the first end of said insert.

16. The parallel flow heat exchanger of claim 15 wherein the nozzle plate comprises an orifice plate.

17. The parallel flow heat exchanger of claim 15 wherein the nozzle plate comprises a convergent-divergent nozzle.

* * * * *